US005512704A

United States Patent [19]

Adachi

[11] Patent Number: 5,512,704

[45] Date of Patent: Apr. 30, 1996

[54] ELECTRONIC SOUND SIGNAL GENERATOR ACHIEVING SCRATCH SOUND EFFECT USING SCRATCH READOUT FROM WAVEFORM MEMORY

[75] Inventor: Jun Adachi, Hamamatsu, Japan

[73] Assignee: Yamaha Corporation, Japan

[21] Appl. No.: 134,394

[22] Filed: Oct. 12, 1993

[30] Foreign Application Priority Data

Oct. 12, 1992 [JP] Japan ..... 4-298192

[51] Int. Cl.[6] ..... G10H 7/00

[52] U.S. Cl. ..... 84/605; 84/628

[58] Field of Search ..... 84/600–602, 605, 84/626, 628

[56] References Cited

U.S. PATENT DOCUMENTS

| | | | |
|---|---|---|---|
| 4,179,971 | 12/1979 | Takahashi et al. . | |
| 4,768,413 | 9/1988 | Fujimori . | |
| 4,813,327 | 3/1989 | Abe . | |
| 4,961,363 | 10/1990 | Mizuno et al. . | |
| 5,239,123 | 8/1993 | Fujita | 84/605 |
| 5,350,882 | 9/1994 | Koguchi et al. | 84/636 |

FOREIGN PATENT DOCUMENTS 59-109090 6/1984 Japan .

*Primary Examiner*—William M. Shoop, Jr.
*Assistant Examiner*—Jeffrey W. Donels
*Attorney, Agent, or Firm*—Graham & James

[57] ABSTRACT

While a sound waveform is reproductively read out from a waveform memory in accordance with a readout rate designated in correspondence to a desired pitch, scratch control data for controlling readout rate and readout direction are generated using a manual controller or an envelope function generator. In accordance with the scratch control data, the readout rate is changed. The thus-changed readout rate is of a positive or negative value depending on a factor that controls the readout direction. Readout from the waveform memory of the waveform data is controlled on the basis of the changed readout rate so that, when the changed rate is of a positive value, the waveform data are read out from the memory in the forward direction at a readout speed corresponding to the rate value, and when the changed rate is of a negative value, the waveform data are read out from the memory in the reverse direction. Further, when the changed rate is zero, the waveform data readout is stopped. Thus, in accordance with time-variable conditions of the scratch data, it is possible to perform a variety of waveform readout controls, such as discontinuing readout, accelerating and slowing down readout in the forward direction, and switching to readout in the reverse direction and accelerating and slowing down readout in the reverse direction.

11 Claims, 4 Drawing Sheets

ELECTRONIC SOUND SIGNAL GENERATOR ACHIEVING SCRATCH SOUND EFFECT USING SCRATCH READOUT FROM WAVEFORM MEMORY

BACKGROUND OF THE INVENTION

This invention generally relates to an electronic sound signal generator which is suitable for use in electronic musical instruments or other tone generating devices, sound signal processing devices or the like, and more particularly to such an electronic sound signal generator which is capable of achieving a scratch sound effect.

As a prior art technique for making tone waveforms in electronic musical instruments, a waveform memory readout system is generally known in accordance with which tone actually generated acoustically from a natural musical instrument or the like is sampled and stored as waveform data in a memory or other suitable storage medium, and then the thus-stored waveform data are read out in accordance with phase angle data. This waveform memory readout system is advantageous in that it can provide tone of the same high quality as that provided by the corresponding natural musical instrument.

In such a waveform memory readout system, the waveform data are typically stored on just one cycle or plural cycles of a waveform. But, with a view to expressing time-varying changes in tone color etc., some type of the waveform memory readout system stores waveform data on the entire waveform, i.e., from beginning to end (from attack portion to decay portion) of the generated tone, so that they are thoroughly read out in response to a key depression on a keyboard.

Further, another type of the waveform memory readout system is also known in accordance with which, in order to easily make such data that require no large storage capacity, waveform data on the rise portion (attack portion) are stored for plural cycles and waveform data on the following sustain portion are stored for just one cycle, so that the plural-cycle waveform data are read out for reproducing the attack portion and then the one-cycle waveform data are read out for reproducing the sustain portion. With this type, the original tone can be stored in an effectively compressed state without lowering the tonal quality, and therefore it is possible to faithfully reproduce the original tone with high reality and abundant expression (Japanese Patent Laid-open Publication No. 59-109090).

As mentioned above conventional electronic musical instruments reproductively generate a tone by reading out memory-stored waveform data with a readout speed (phase angle) that corresponds to the pitch of a tone to be generated. As a method for imparting a special effect in connection with the waveform readout, some of the conventional electronic musical instruments control the waveform data readout speed by pitch bending, or time-varies the waveform data readout speed by using a pitch bend envelope generator to change the pitch bend depth (U.S. Pat. Nos. 4,179,971, 4,813,327 and 4,961,363).

However, the pitch bend control can only increase or decrease the pitch of generated tone and therefore can only time-varies the pitch of generated tone. Namely, with the prior art techniques, it is not at all possible to simulate such scratch effect sounds that can be provided by analog record reproduction devices (players), i.e., to simulate a sound effect that can be obtained by forcing a record to rotate in the reverse or reverse direction or to move irregularly.

SUMMARY OF THE INVENTION

Therefore, it is an object of the present invention to provide an electronic sound signal generator which is capable of achieving a scratch sound effect by freely controlling readout from a waveform memory.

In order to achieve the above-mentioned object, an electronic sound signal generator according to the present invention comprises a waveform storage section for storing sound waveform data in a predetermined order, a rate designation section for designating a readout rate to read out the waveform data from the waveform storage section in correspondence to a given pitch, a scratch control section for generating time-variable scratch control data to control readout rate and readout direction, a rate change section for changing the readout rate designated by the rate designation section in accordance with the scratch control data, the readout rate thus changed by the rate change section being of a positive or negative value, and a readout control section for performing a control such that the waveform data are read out from the waveform storage section on the basis of the changed readout rate, a direction in which the waveform data are read out from the waveform storage section being controlled to be a forward or reverse direction depending on whether the changed readout data is of a positive or negative value.

The scratch control section is provided for simulating a scratch action, and scratch control data generated by this scratch control section is time-variable data for controlling readout rate and readout direction. In accordance with the scratch control data, the readout rate is changed. The thus-changed readout rate is of a positive or negative value depending on a factor that controls the readout direction. Readout from the waveform memory of the waveform data is controlled on the basis of the changed readout rate. Because the arrangement is such that the changed readout rate has a positive or negative value, when the changed readout rate is of a positive value, the waveform data are read out from the memory in the forward direction at a readout speed corresponding to the rate value. On the other hand, when the changed readout rate is of a negative value, the waveform data are read out from the memory in the reverse direction at a readout speed corresponding to the rate value. Further, when the changed readout rate is zero, the waveform data readout is stopped.

Thus, in accordance with time-variable conditions of the scratch data, it is possible to perform a variety of waveform readout controls, such as discontinuing readout, accelerating and slowing down readout in the forward direction, and switching to readout in the reverse direction and accelerating and slowing down readout in the reverse direction. Accordingly, it is possible to impart an electronically generated sound signal a special effect that is equivalent to the scratch effect obtained by stopping rotation of a disk, accelerating or slowing down a rotating disk, or rotating a disk in the reverse direction. Because this electronic sound waveform data is arranged to change a readout rate in correspondence to a given pitch, when generation of the scratch data is stopped, the readout rate is not changed any longer and normal sound waveform reproduction at a given pitch is resumed. This means that as the scratch action is stopped, normal sound reproduction is guaranteed.

Now, the preferred embodiment of the present invention will be described with reference to the accompanying drawings.

DETAILED DESCRIPTION OF THE PREFERRED EMBODIMENT

Figure 1:
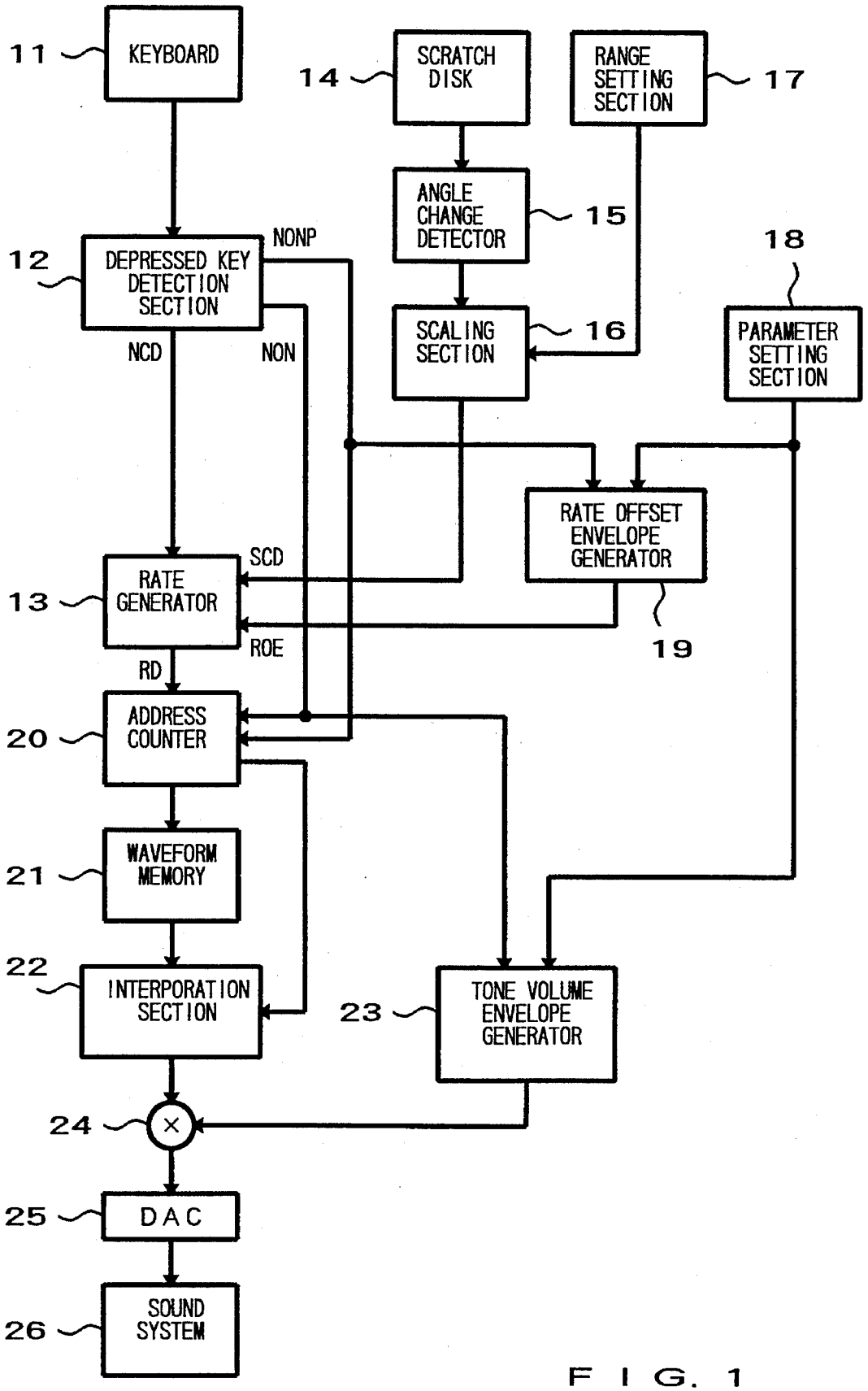
FIG. 1 is a hardware block diagram of the overall structure of an electronic musical instrument in accordance with one embodiment of the present invention.

FIG. 1 is a hardware block diagram illustrating the overall structure of an electronic musical instrument in which is incorporated a waveform data readout device according to the present invention.

In the embodiment of FIG. 1, a keyboard 11 includes a plurality of keys for selecting tones to be generated, and a plurality of key switches provided in corresponding relation to the keys.

A depressed key detection section 12 detects the state of the keyboard 11 (state as to whether any key has been depressed or released), namely, it detects ON/OFF of each key switch in the keyboard 11. For example, the depressed key detection section 12 comprises a scan circuit for sequentially scanning the key switches, and a circuit for encoding the scan results. Thus, the depressed key detection section 12 provides a rate generator 13 with a note card signal NCD identifying a depressed key, also provides a rate offset envelope generator 19 and an address counter 20 with a note-on pulse signal NONP indicative of a key depression event, and also provides the address counter 20 and a tone volume envelope generator 23 with a note-on signal NON indicative of the continuance of a key-depressed state. Accordingly, when the depressed key detection section 12 has stopped outputting the note-on signal NON, it is meant that the corresponding key has been released from the depressed state. In addition, the depressed key detection section 12 outputs initial touch data by detecting the velocity of each key depression operation on the basis of the output from the key switch, as well as after-touch data by detecting the after-touch pressing force on each depressed key on the basis of the output from a depression force detection device while the key is pressed.

A scratch disk 14 comprises an operating member in the form of a disk-shaped turntable, and a rotary encoder which generates pulse signals corresponding to the rotation direction and amount of the operating member.

An angle change detector 15 inputs thereto the pulse signals generated from the scratch disk 14, on the basis of which the section 15 detects the amount of change in the rotation angle (angular position) of the scratch disk 14. The detected change amount is output to a scaling section 16. Namely, the angle change detector 15 outputs data corresponding to the amount of rotation when the scratch disk 14 has rotated, but it outputs no data when the scratch disk 14 is in the stopped state.

A range setting section 17 comprises an operating member for selecting and setting range data for determining the range of waveform readout speed per rotation of the scratch disk 14 (for instance, one of ½, 1, 2, 4 and 8 seconds) and the range data set by this setting section 17 is provided to the scaling section 16.

The scaling section 16 multiplies the rotation angle change amount output from the angle change detector 15, by the range data output from the range setting section 17 and then outputs the multiplication result to the rate generator 13 as scratch data SCD. For instance, if the range data is one second and the rotation angle change amount is ¼, scratch data SCD indicating 0.25 second will be output from the scaling section 16.

A parameter setting section 18 outputs parameter for designating the type of envelope waveforms to be generated by the rate offset envelope generator 19 and tone volume generator 23, respectively. This parameter setting section 18 may comprise an envelope parameter setting means which is used exclusively for a scratch effect or may be arranged to operate in response to selection of tone color or other tonal effects.

Figure 2:
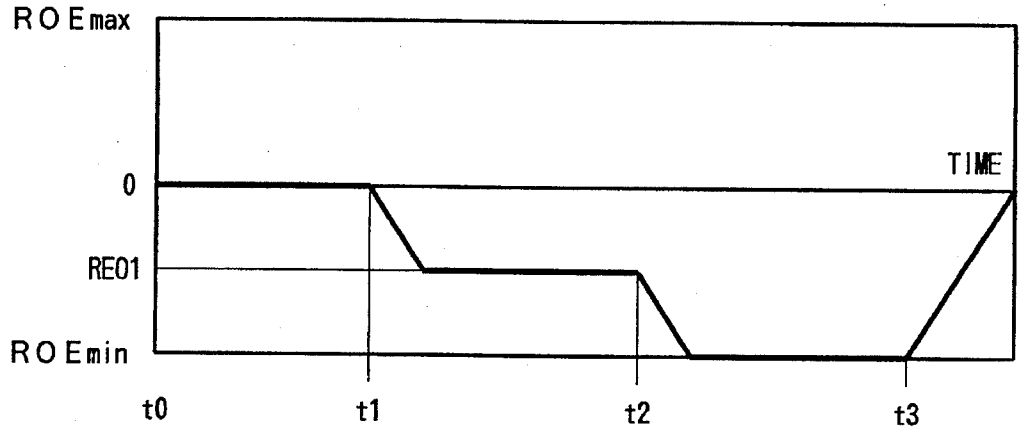
FIG. 2 is a graphic representation of an example of rate offset envelope data generated by a rate offset envelope data generator shown in FIG. 1.

In synchronism with the input thereto of the note-on signal NON from the depressed key detection section 12, the rate offset envelope generator 19 provides the rate generator 13 with rate offset envelope data ROE that corresponds to the parameter previously set by the parameter setting section 18. FIG. 2 is a diagram illustrating an example of the rate offset envelope data ROE generated by the rate offset envelope generator 19. In FIG. 2, the horizontal axis represents time, while the vertical axis represents the level of the rate offset envelope data ROE. The level of the rate offset envelope data ROE in this example is "0" till time point t1, from which it gradually decreases to "ROE1". After that, the level again decreases from time point t2 to reach a minimum value "ROEmin" and then gradually increases from time point t3 to return to "0".

Figure 3:
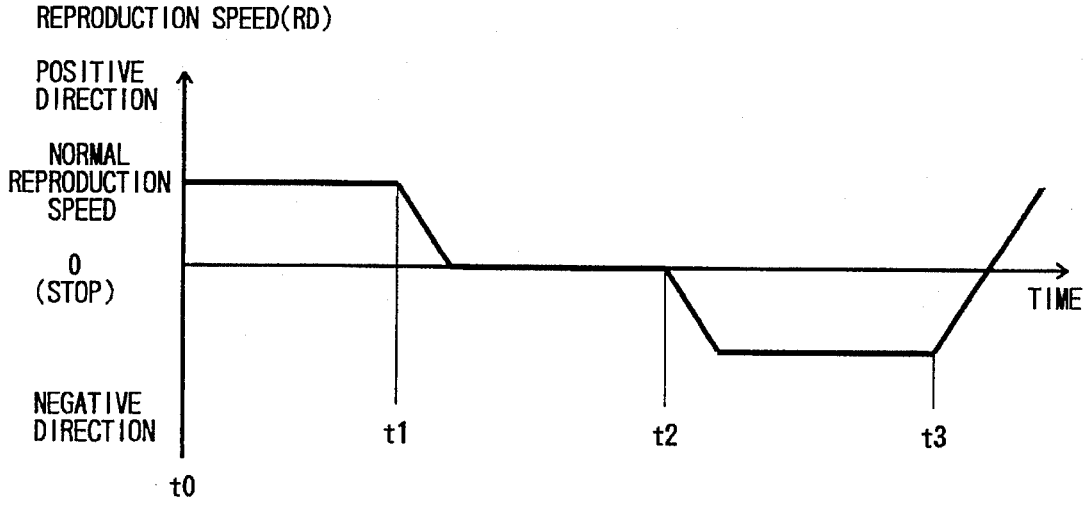
FIG. 3 is a graphic representation of an example of rate data generated by a rate generator of FIG. 1 in correspondence to the rate offset envelope data shown in FIG. 2.

If, for example the scratch data SCD is "0" and the rate offset data ROE as shown in FIG. 2 alone is input to the rate generator 13, the generator 13 will output to the address counter 20 such rate data RD as shown in FIG. 3. Accordingly, the speed of reproduction or readout from a waveform memory 21 will also change in a manner as shown in FIG. 3. Namely, the level of the rate data RD stays at a value corresponding to a normal reproduction speed while the rate offset data ROE is at level "0" (t0–t1), but the rate data RD becomes "0" when the level of the rate offset envelope data ROE gradually decreases to reach "ROE1", upon which the reproduction from the waveform memory 21 is caused to stop. Further, when the level of the rate offset envelope data ROE decreases from time point t2 to reach the minimum value "ROEmin", the rate data RD becomes a negative value, upon which waveform reproduction in the reverse or opposite direction begins. Then, from time point t3, the level of the rate offset envelope data ROE gradually increases, so that the rate data RD increases in the positive direction to reach the normal reproduction speed.

The tone volume envelope generator 23, in synchronism with the input thereto of the note-on pulse NONP from the depressed key detection section 12, provides a multiplier 24 with tone volume envelope signal that corresponds to the parameter previously set by the parameter setting section 18. It should be noted here that the tone volume envelope generator 23 may be arranged to output the envelope signal after having been variably controlled on the basis of the initial touch data and after-touch data.

The rate generator 13 inputs thereto the note code NCD from the depressed key detection section 12, the scratch data SCD from the scaling section 16 and the rate offset envelope data ROE from the rate offset envelope generator 19, so that the generator 13 outputs to the address counter 20 rate data RD based on these input data. The rate data RD is composed of an integer portion and a decimal fraction portion. The structure of the rate generator 13 will be described in detail later.

The address counter 20 is reset to an initial address in response to the note-on pulse NONP from the depressed key detection section 12 and then outputs readout addresses to the waveform memory 21 which sequentially change in accordance with the magnitude of the rate data RD. It is to be noted that, of each address output from the address counter 20, data of the integer portion is provided to the waveform memory 21, and data of the decimal fraction portion is provided to an interpolation section 22. When the rate data RD is small in value, the address increment rate in the address counter 20 is caused to be low, which results in a low pitch of tone waveform signal. Conversely, when the rate data RD is large in value, the address increment rate in the address counter 20 is caused to be high, which results in a high pitch of waveform signal. Further, when the rate data RD is of a negative value, the address counter 20 outputs addresses which sequentially become smaller in value, so that waveform data are read out from the waveform memory 21 in the reverse or backward direction. The structure of the address counter 20 will be described in detail later.

Figure 4:
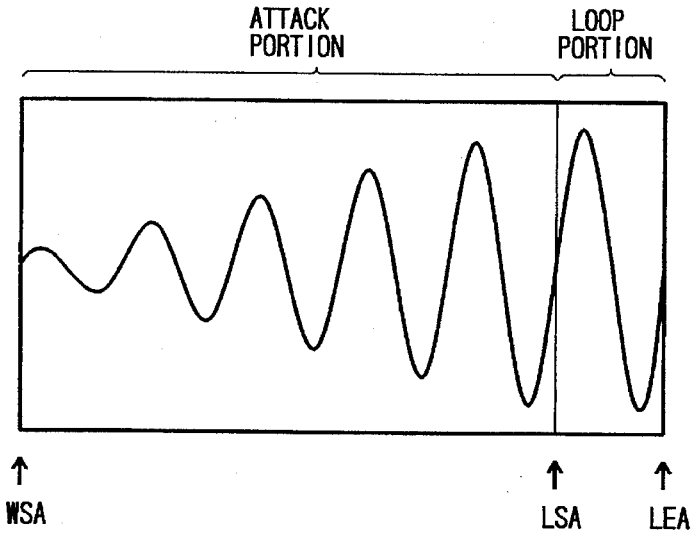
FIG. 4 is a waveform diagram illustrating an example of waveform data stored in a waveform memory of FIG. 1.

In the waveform memory 21, there are stored waveform data on plural cycles of the rise portion (attack portion) of a waveform and on one cycle of the following sustain portion (loop portion) as shown in FIG. 4.

The interpolation section 22 inputs thereto the decimal fraction portion of each address provided from the address counter 20, in accordance with which the section 22 interpolates between waveform data read out from the waveform memory 21.

A multiplier 24 multiplies the tone waveform signal interpolated by the interpolation section 22, by the tone volume envelope signal provided from the tone volume envelope generator 23, and it then provides a digital-to-analog converter (DAC) 25 with the multiplication result as a tone signal.

The digital-to-analog converter 25 converts the tone signal provided from the multiplier 24 into an analog tone signal and outputs the thus-converted signal to a sound system 26.

The sound system 26, which comprises speaker, amplifier etc., generates a tone corresponding to the analog tone signal output from the digital-to-analog converter 25.

Figure 5:
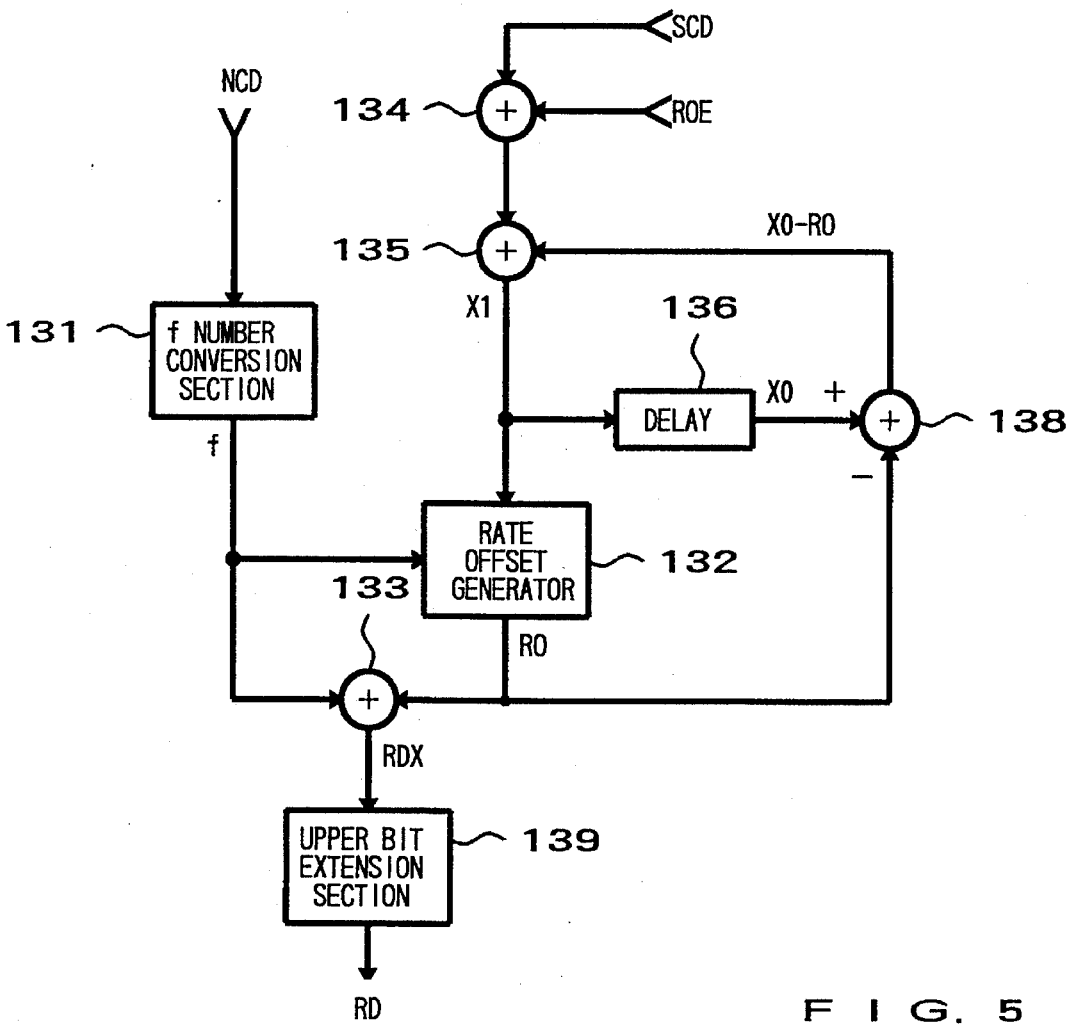
FIG. 5 is a block diagram illustrating in detail an example structure of the rate generator shown in FIG. 1.

FIG. 5 is a block diagram illustrating in detail the structure of the rate generator 13 of FIG. 1.

An f-number conversion section 131 provides a rate offset generator 132 and an adder 133 with frequency data f corresponding to the note code data NCD from the depressed key detection section 12.

Figure 6:
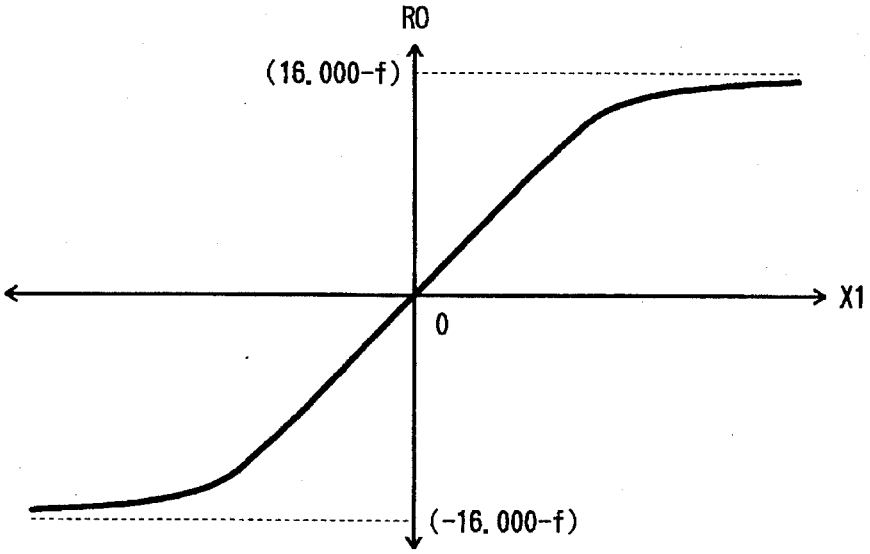
FIG. 6 is a graphic representation of characteristic of rate offset data generated by a rate offset generator shown in FIG. 5.

The rate offset generator 132 inputs thereto the frequency data f and offset data X1 from an adder 135, so as to provide the adder 133 and subtracter 138 with rate offset data RO corresponding to these input data f and X1. FIG. 6 shows characteristics with which the rate offset data generator 132 generates the rate offset data RO. In FIG. 6, the offset data X1 is allotted to the horizontal axis, and the rate offset data RO is allotted to the vertical axis. As may be clear from the figure, the rate offset generator 132 outputs as the rate offset data RO such a value within a range from the maximum value of "16,000-f" to the minimum value of "–16,000-f".

The adder 133 ads the frequency data f with the rate offset data RO and provides an upper bit extension section 139 with the addition result (i.e., sum) as rate data RDX. Therefore, the adder 133 provides rate data RDX which ranges from the maximum value of "16" to the minimum value of "–16". The reason why the absolute value of the maximum and minimum values of rate data RDX is "16" is that the limit of skipping readout by the address counter 20 corresponds to four octaves (16 sampling periods).

An adder 134 adds the scratch data SCD provided from the scaling section 16 with the rate offset envelope data ROE provided from the rate offset envelope generator 19, so as to output the sum of (SCD+ROE) to the above-mentioned adder 135. Namely, the scratch sound effect can be achieved through the operation of the scratch disk 14 alone or the application of envelope data alone, or through a combined use of these two approaches.

The adder 135 adds the sum (SCD+ROE) provided from the adder 134 with a subtraction result (difference) of (X0–RO) provided from the subtracter 138 and then outputs the sum (X1=SCD+ROE+X0–RO) to a delay circuit 136 as well as the rate offset generator 132.

The delay circuit 136 serves to delay the sum X1 by one sampling period and outputs a resultant delay signal X0 to the subtracter 138.

The subtracter 138 subtracts the rate offset data RO from the delay signal X0 and then outputs the difference (X0–RO) to the adder 135.

Namely, a loop circuit which is composed of the adder 135, delay circuit 136 and subtracter 138 increments the sum (SCD+ROE) and decrements the rate offset data RO. Accordingly, the value of the sum X1 is caused to gradually increase by the sum (SCD+ROE), but when the sum (SCD+ROE) becomes zero, it is caused to gradually decrease to zero.

The upper bit extension section 139 increases the number of bits of the rate data RDX provided from the adder 133, in such a manner that the bit number of the data RDX coincides with the number of bits of the address counter 20. The upper bit extension section 139 outputs the bit-increased rate data RD to the address counter 20.

In this way, the rate generator 13 provides the address counter 20 with rate data RD of a value ranging from "+16" to "–16", depending on the sum of the scratch data SCD provided from the scaling section 16 and the rate offset envelope data ROE provided from the rate offset envelope generator 19.

If it is desired, in the electronic musical instrument according to this embodiment, to add pitch envelope signal generated from a conventionally-known pitch envelope generation circuit (not shown), such a desired addition can be achieved by adding pitch envelope signal that is given by cent, to note code data that is also given by cent.

because of the above-mentioned arrangements, the value of the rate data generated from the rate generator 13 can be varied as desired from a positive value to a negative value. Therefore, in such a case where the waveform memory 21 stores therein waveform data on one cycle of the waveform or on the entire waveform (from attack portion to decay portion), it may be only sufficient that the address counter 20 merely accumulates the values of the rate data RD. However, since in this embodiment the waveform memory 21 only stores waveform data on plural cycles of the rise (attack) portion and one cycle of the following sustain (loop) portion as shown in FIG. 4, the address counter 20 can never read out the waveform data from the memory 21 only by merely accumulating the rate data RD. For this reason, the address counter 20 in this embodiment is constructed in the following manner, so as to read out the waveform data from the memory 21.

Figure 7:
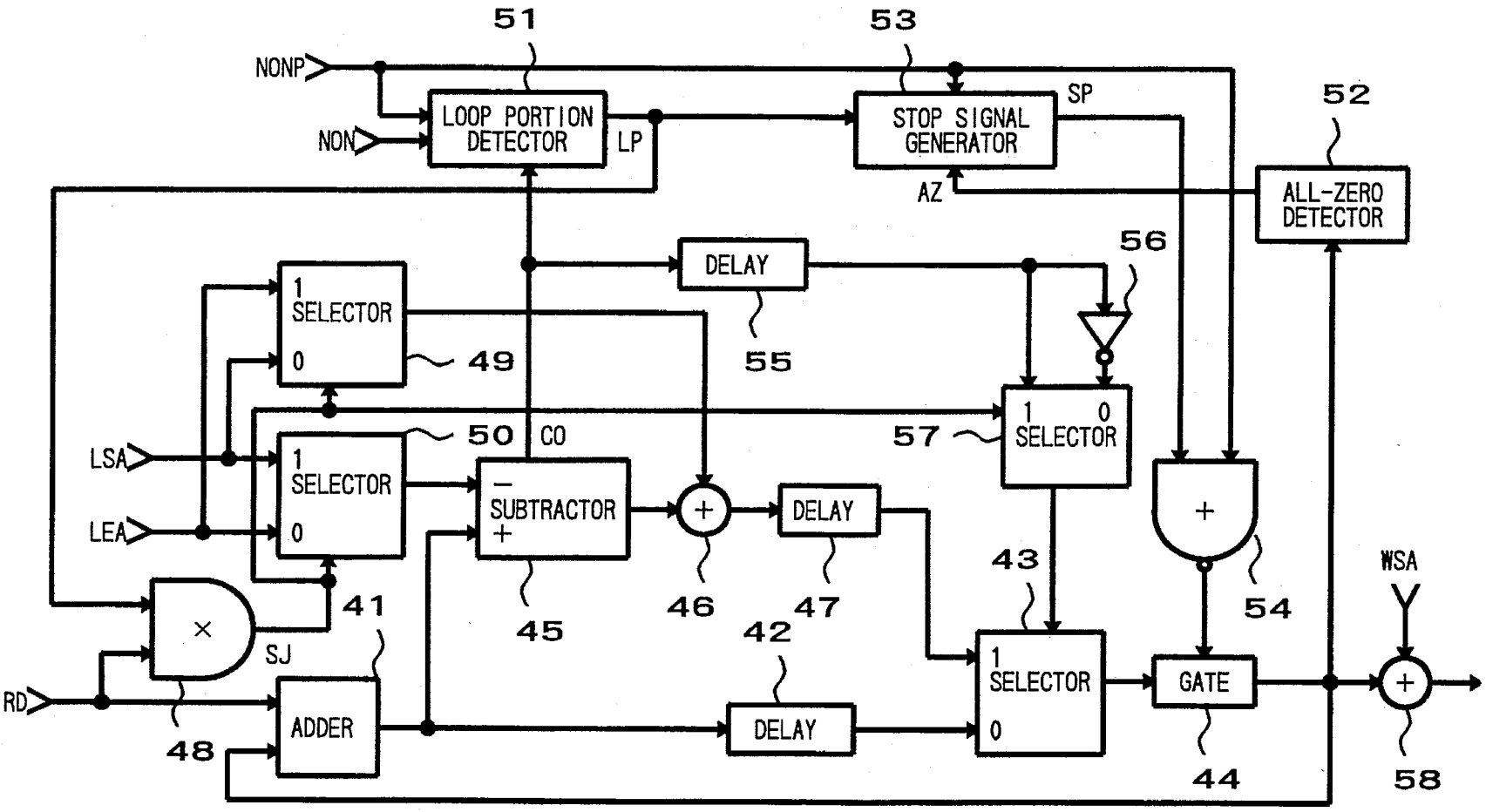
FIG. 7 is a block diagram illustrating in detail an example structure of an address counter shown in FIG. 1.

FIG. 7 illustrates the structure of the address counter 20 in detail.

In this embodiment, when rate data RD of a negative value is output from the rate generator 13 while the waveform data on the attack portion is read out, the address counter 20 reads out the waveform data of the attack portion in the reverse or backward direction, until the counter 20 stops such a readout action on reading out all the waveform data on the attack portion. On the other hand, when rate data RD of a negative value is output from the rate generator 13 while the waveform data of the loop portion is read out, the address counter 20 repetitively reads out the waveform data on the loop portion in the reverse direction without reading out the waveform data on the attack portion.

An adder 41 inputs thereto the rate data RD from the rate generator 13 and adds the input rate data RD with rate data of the preceding sampling period which is output via a delay circuit 42, selector circuit 43 and gate circuit 44. The rate data RD thus-added with the rate data of the preceding period is output to the plus terminal of a subtracter 45 as well as the delay circuit 42. The delay circuit 42 delays the sum (accumulated value) from the adder 41 by one sampling period and outputs the thus-delayed sum to the selector circuit 43. The selector 43 in turn provides the gate circuit 44 with a selected one of the outputs of the delay circuits 42 and 47 depending on the output level of a selector circuit 57.

The gate circuit 44 is caused to open when a NOR having high level "1" is input thereto from a NOR circuit 54 and is caused to close when a NOR having low level "0" is input thereto from the NOR circuit 54. Namely, the gate circuit 44 inputs thereto the note-on pulse NONP via the NOR circuit 54. When the note-on pulse NONP becomes low level "0", the NOR circuit 54 outputs a NOR having low level "0" to the gate circuit 44, so that the gate is temporarily closed. Then, when the note-on pulse NONP becomes high level "1", it outputs a NOR having high level "1" to the gate circuit 44, so that the gate is opened. Accordingly, the gate circuit 44 serves to reset the accumulated value every time the note-on pulse NONP is input. The gate circuit 44 continues to output the accumulated value from the selector circuit 43 to the adder 41, all-zero detection circuit 52 and adder 58 while the gate is open, but when a stop signal SP of high level "1" is provided from a stop signal generator 53 via the NOR circuit 54, the gate is closed.

An AND circuit 48 inputs thereto the uppermost bit, i.e., most significant bit (MSB) of the rate data RD and a loop signal LP from a loop portion detector 41, and it outputs an AND between the two input data to selector circuits 49, 50 and 57. The most significant bit is low level "0" if the rate data RD is of a positive value, but it is high level "1" if the rate data RD is of a negative value.

The loop value LP has a low level "0" if the accumulated value output from the adder 41 falls between waveform start address WSA and loop end address LEA of the waveform data shown in FIG. 4, but the signal LP has high level "1" if the accumulated value falls between loop start address LSA and loop end address LEA after having once passed beyond the loop end address LEA. Therefore, the AND circuit 48 output a select signal of high level "1" only when the rate data RD is of a negative value and also the accumulated value output from the adder 41 falls between the loop start address LSA and the loop end address LEA; otherwise, the AND circuit 48 outputs a select signal SJ of low level "0".

The selector circuit 49, which inputs thereto the loop start address LSA and loop end address LEA of the waveform data shown in FIG. 4, outputs the loop end address LEA to the adder 46 when the select signal SJ of low level "0" is input thereto and outputs the loop start address LSA to the adder 46 when the select signal SJ of high level "1" is input thereto.

The selector circuit 50, which also inputs thereto the loop start address LSA and loop end address LEA of the waveform data shown in FIG. 4, outputs the loop end address LEA to the minus terminal of the subtracter 45 when the select signal SJ of low level "0" is input thereto and outputs the loop start address LSA to the minus terminal when the select signal SJ of high level "1" is input thereto.

The subtracter 45 subtracts the loop start address LSA or loop end address LEA selected and output by the selector circuit 50, from the accumulated value output from the adder 41, so as to output the difference to the adder 46. The difference thus obtained in the subtracter 45 will be of a negative value if the accumulated value is smaller than the loop start address LSA or loop end address LEA, in which case the subtracter 45 outputs a carry-out signal CO of high level "1" to the loop portion detector 51 and delay circuit 55. Conversely, if the accumulated value is greater than the loop start address LSA or loop end address LEA, the difference obtained in the subtracter 45 will be of a positive value, in which case the subtracter 45 outputs a carry-out signal CO of low level "0" to the loop portion detector 51 and delay circuit 55.

The adder 46 adds the difference provided from the subtracter 45, with the loop start address LSA or loop end address LEA, and it then outputs the addition result or sum to a delay circuit 47. The delay circuit 47 in turn outputs the sum with a delay of one sampling period.

The loop portion detector 51 normally continues to output the loop signal LP of low level "0" to the AND circuit 48 and stop signal generator 53. But, once the carry-out signal CO of low level "0" has been generated from the subtracter 45 after input of the note-on pulse NONP while the note-on signal is at high level "1", the loop portion detector 51 outputs the loop signal of high level "1" since this means that the accumulated value in the adder 41 has reached the loop end address LEA of the waveform data shown in FIG. 4.

The all-zero detector 52 inputs thereto the accumulated value output from the gate circuit 44, and it then outputs a all-zero signal AZ to the stop signal generator 53 at a time point when the accumulated value has become equal to or smaller than "0".

The stop signal generator 53 inputs thereto the loop signal LP, note-on pulse NONP and all-zero signal AZ. At a time point when the all-zero signal AZ has been input after the note-on pulse NONP while the loop signal LP is at low level "0", the stop signal generator 53 outputs a stop signal SP of high level "1" to the NOR circuit 54. Then, the stop signal generator 53 is reset by inputting thereto the note-on pulse NONP, so as to output a stop signal of low level "0".

Namely, in this example, the fact that the accumulated value from the gate circuit 44 which has become equal to or smaller than "0" means that the rate data RD has changed to a negative value and the waveform data of the attack portion have been read out in the reverse direction. Therefore, at such a time point when the all-zero signal AZ has been output from the all-zero detector, the stop signal generator 53 outputs a stop signal SP of high level "1" to the NOR circuit 54, in order to stop readout from the waveform memory 21.

The NOR circuit 54 inputs thereto the stop signal SP and note-on pulse NONP and outputs a NOR between the input two signals to the gate circuit 44. More specifically, the NOR circuit 54 outputs a NOR having high level "1" when the stop signal SP and note-on pulse NONP are both at low level "0"; otherwise the NOR circuit 54 outputs low level "0". Accordingly, the NOR circuit 54 outputs a NOR having low level "0" to the gate circuit 44 when the high level stop signal SP has been input thereto from the stop signal generator 53.

The delay circuit 55 inputs thereto the carry-out signal CO from the subtracter 45 to delays the signal CO by one sampling period. The thus-delayed carry out signal CO is provided to an inverter circuit 56 and to the selector circuit 57. The inverter circuit 56 inverts the output of the delay circuit 55 and provides a selector circuit 57 with the thus-inverted output. The selector circuit 57 inputs thereto the select signal SJ from the AND circuit 48 and provides the selection terminal of the selector 43 with a selected one of the input signals depending on the level of the select signal SJ.

The adder 58 adds the waveform start address WSA with the accumulated value output from the gate circuit 44 and outputs the addition result to the selection terminal of the selector 43.

Next, description will be made on an example of the operation of the address counter 20 shown in FIG. 7.

First description will be on the operation of the address counter 20 in such a case where the rate data RD is of a positive value (fixed positive value).

When the keyboard 11 is operated, the depressed key detection section 12 outputs a note-on pulse NONP. The loop portion detector 51 inputs thereto the note-on pulse NONP to thereby reset the loop signal LP to low level "0". Also the NOR circuit 54 inputs thereto the high level "1" of the note-on pulse NONP, to thereby output to the gate circuit 44 a NOR having low level "0". In response to the low level NOR, the gate circuit 44 closes the gate, so that the value accumulated by an accumulation loop which comprises the adder 41, delay circuit 42, selector 43 and gate circuit 44 is reset to "0". Thus, the adder 58 outputs the waveform start address WSA to the waveform memory 21.

Then, when the note-on pulse NONP has become low level "0", the stop signal generator 53 is reset to output a stop signal SP of low level "0". The NOR circuit 54 outputs a high level NOR to the gate circuit 44, in response to which the gate circuit 44 opens the gate.

Since at this time the rate data RD is of a positive value and thus low level "0" of its most significant bit is input to the AND circuit 48, the AND circuit 48 outputs a select signal SJ of low level "0" to the selector circuits 49, 50 and 57. The selector circuit 49 outputs the loop start address LSA to the adder 46, and the selector circuit 50 outputs the loop end address LEA to the subtracter 45.

The selector circuit 57 outputs the inverted value from the inverter circuit 56 to the selector circuit 43. Since the accumulated value output from the adder 41 when the note-on pulse NONP has been output is smaller than the loop end address LEA, a carry out signal CO of high level "1" is output from the subtracter 45 and a select signal CO of low level "0" is output from the selector circuit 57 to the selector circuit 43. Accordingly, the selector circuit 43 selects the output of the delay circuit 42 and delivers it to the adder 58 via the gate circuit 44. Then, the adder 58 provides the waveform memory 21 with the addition result between the rate data RD given via the adder 41 and delay circuit 42 and the waveform start address WSA (WSA+RD).

Thereafter, the value accumulated by the accumulation loop comprising the adder 41, delay circuit 42, selector circuit 43 and gate circuit 44 increases in accordance with the rate address RD in such a manner as (2×RD), (3×RD), (4×RD), . . . , and read addresses like (WSA+2×RD), (WSA+3×RD), (WSA+4×RD), . . . are also sequentially output from the adder 58.

Next, description will be made on the operation in such a case where the rate data RD has changed to a negative value (here denoted by "–rd") when the accumulated value (n×RD) output from the adder 41 is smaller than the loop end address LEA, i.e., when the waveform data of the attack and loop portions have not yet been thoroughly read out from the waveform memory 21.

Since in this case the rate data is of a negative value –rd, the most significant bit MSB is at high level "1". But, the low level loop signal LP is still being input to the AND circuit 48, the select signal SJ remains at low level "0", so that the selection state of the selector circuits 43, 49, 50 and 57 also remain unchanged.

Thereafter, the value accumulated by the accumulation loop comprising the adder 41, delay circuit 42, selector circuit 43 and gate circuit 44 decreases in accordance with the negative rate address –rd in such a manner as (n×RD–rd), (n×RD–2×rd), (n×RD–3×rd), . . . , and read addresses like (WSA+n×RD–rd), (WSA+n×RD–2×rd), (WSA+n×RD–3×rd), . . . are also sequentially output from the adder 58 in the reverse direction.

When such an accumulation process has been repetitively performed m times until (m×rd) becomes equal to or greater than (n×RD), this means that the readout address output from the adder 58 has reached the waveform start address WSA shown in FIG. 4, and thus the all-zero detector 52 outputs an all-zero signal AZ to the stop signal generator 53. The stop signal generator 53, in response to the all-zero signal AZ, outputs a high level stop signal SP to the NOR circuit 54, and thus the gate circuit 44 is closed so that the address counting process will not be performed any longer.

Next, description will be made on the operation in such a case where the accumulated value output from the adder 41 has become greater than the loop end address LEA and thus the rate data RD has changed to a negative value –rd while the waveform data on the loop portion are repetitively read out.

Once the accumulated value output from the adder 41 has exceeded the loop end address LEA by Δa, the difference provided from the subtracter 45 changes to a positive value Δa, so that the subtracter 45 outputs a carry-out signal CO of low level "0". The output from the subtracter 45 of the low level carry-out signal CO signifies that the waveform data on the attack and loop portions have been thoroughly read out. Therefore, the loop portion detector 51 inputs thereto the high level carry-out signal CO continues to provide the AND circuit 48 and stop signal generator 53 with a high level loop signal LP until the detector 51 is reset by the note-on pulse NONP. In response to the high level loop signal LP, the stop signal generator 53 thereafter ignores the all-zero signal AZ from the all-zero detector 52.

Even when the loop signal LP has changed to high level "1", the rate data RD is still a positive value and thus the AND circuit 48 still continues to output the low level select signal SJ. Therefore, the respective selection states of the selector circuits 49, 50 and 57 remain unchanged. However, because the delay circuit 55 is caused to output the low level carry-out signal CO to the inverter circuit 56 with a delay time of one sampling period, the selector circuit 57 outputs a signal of high level "1" to the selection terminal of the selector circuit 43. Then, via the gate circuit 44, the selector circuit 43 provides the output value of the delay circuit 47 which is the sum of the subtraction result Δa of the subtracter 45 and the loop start address LSA (LSA+Δa). In this way, a readout address corresponding to the sum of (WSA+LSA+Δa) is output from the adder 58.

Then, at the next sampling period, the adder 41 provides, as a new accumulated value, the sum of the output value (LSA+Δa) of the gate circuit 44 and the rate data RD (LSA+Δa+RD). This new accumulated value (LSA+Δa+RD) is smaller than the loop end address LEA, and so, at this time, the subtracter 45 outputs a high level carry-out signal CO. One sampling period later, the delay circuit 55 delivers the high level carry-out signal CO to the inverter circuit 56, so that the selector circuit 57 outputs a low level select signal to the selector circuit 43. In response to this, the selector circuit 43 selects the output of the delay circuit 42 and gives it to the adder 58 via the gate circuit 44. The adder 58 in turn provides the waveform memory 21 with the sum of the accumulated value ((LSA+ Δa+RD) given via the adder 41 and delay circuit 42 and the waveform start address WSA (WSA+LSA+Δa+RD).

Thereafter, the accumulated value provided from the accumulation loop comprising the adder 41, delay circuit 42, selector circuit 43 and gate circuit 44 increases in accordance with the rate data RD in such a manner as (LSA+Δa+2×RD), (LSA+Δa+3×RD), (LSA+Δa+4 ×RD), . . . , and the adder 58 sequentially outputs readout addresses like (WSA+LSA+Δa+2×RD), (WSA+ LSA+Δa+3×RD), (WSA+LSA+Δa+4×RD). Then, from a time point when the accumulated value output from the adder 41 has become greater than the loop end address LEA, the rate data RD are added to the sum of the difference Δb and loop start address LSA (LSA+Δb) one after another, to read out the waveform data on the loop portion.

When the rate data RD has changed to a negative value −rd while the loop portion waveform data are repetitively read out from the waveform memory 21, the most significant bit MSB of the rate data RD becomes high level "1". Since at this time the loop signal LP is already at high level "1", the AND circuit 48 outputs a high level select signal SJ to the selector circuits 49, 50 and 57 to change the respective selection states thereof. Namely, the selector circuit 49 is caused to output the loop end address LEA to the adder 46, and the selector circuit 50 is caused to out put the loop start address LSA to the subtracter 45. The selector circuit 57 passes the output of the delay circuit 55 to the selection terminal of the selector circuit 43.

If the output value of the gate circuit 44 when the high level select signal SJ has been provided from the AND circuit 48 is greater than the loop start address LSA by a value corresponding to LSE (i.e., LSA+LSE), the adder 41 outputs the sum of the value of (LSA+LSE) and negative rate data −rd (LSA+LSE−rd). If the subtraction result of (LSE−rd) obtained in the subtracter 45 is a positive value, the subtracter 45 outputs a low level carry-out signal CO. The selector circuit 57 outputs a low level select signal to the selection terminal of the selector circuit 43. Then, the selector circuit 43 selects the output of the delay circuit 42 and delivers it to the adder 58 via the gate circuit 44. The adder 58 in turn provides the waveform memory 21 with the sum of the value (LSA+LSE−rd) given via the adder 41 and delay circuit 42 and the waveform start address WSA (WSA+LSA+LSE−rd).

Thereafter, the accumulated value output from the accumulation loop comprising the adder 41, delay circuit 42, selector circuit 43 and gate circuit 44 decreases in accordance with the negative rate address −rd in such a manner as (LSA+LSA−2×rd), (LSA+LSA−3×rd), (LSA+LSA−4×rd), . . . , and readout addresses like (WSA+LSA+LSE−2×rd), (WSA+LSA+LSE−3×rd), (WSA+LSA+LSE−4×rd) are also sequentially output from the adder 58 in the reverse direction.

When such an accumulation operation has been repetitively performed m times until (m×rd) becomes greater than (LSE), the accumulated value (LSA+LSE−m×rd) becomes smaller than LSA.

When the accumulated value output from the adder 41 has become smaller than the loop start address LSA by Δc, the difference obtained in the subtracter 45 becomes a negative value Δc (=LSE−m×rd). Thus, the subtracter 45 outputs a high level carry-out signal CO. The delay circuit 55 then passes the high level carry-out signal CO to the selector circuit 57 with a delay of one sampling time. The selector circuit 57 directly delivers the high level output of the delay circuit 55 to the selection terminal of the selector circuit 43. Then, the selector circuit 43 provides the output value of the delay circuit 47 via the gate circuit 44. As may be obvious from the foregoing, the output value of the delay circuit 47 is the sum obtained by adding the difference (−Δc) from the subtracter 45 and the loop end address LEA (LEA−ΔC). In this way, a readout address corresponding to (WSA+LEA−Δc) is output from the adder 58.

Then, at the next sampling period, the adder 41 provides, as a new accumulated value, the sum of the output value (LEA+Δc) of the gate circuit 44 and the negative rate data −rd (LEA−Δc−rd). This new accumulated value (LEA−Δc−rd) is smaller than the loop end address LEA, and so, at this time, the subtracter 45 outputs a low level carry-out signal CO. Then, with a delay of one sampling period, the delay circuit 55 delivers the low level carry-out signal CO to the selector circuit 43 via the selector circuit 57, so that the selector circuit 43 selects the output of the delay circuit 42 and sends it to the adder 58 via the gate circuit 44. The adder 58 in turn provides the waveform memory 21 with the sum of the accumulated value (LEA−Δc−rd) given via the adder 41 and delay circuit 42 and the waveform start address WSA (WSA+LEA−Δc−rd).

Thereafter, the accumulated value output from the accumulation loop comprising the adder 41, delay circuit 42, selector circuit 43 and gate circuit 44 decreases in accordance with the negative rate address −rd in such a manner as (LEA−Δc−2×rd), (LEA−Δc−3×rd), (LEA− Δc−4×rd), . . . , and readout addresses like (WSA+ LSA−Δc−2×rd), (WSA+ LSA−Δc−3×rd), (LSA+ LSA−Δc−4×rd) are also sequentially output from the adder 58 in the reverse direction. Thus, the waveform data of the loop portion are read out from the waveform memory 21 in the reverse direction. Then, from a time point when the accumulated value output from the adder 41 has again become smaller than the loop start address LSA, the rate data −rd are added to the sum of the subtraction result −Δd and loop end address LEA (LEA−Δd) one after another, to read out the waveform data on the loop portion in the reverse direction.

The embodiment has been described in connection with readout from a waveform memory storing waveform data, but it should be obvious that the present invention may also be applied to read out voice files stored in hard disks.

Further, in the above-described embodiment, the scratch disk 14 comprises an operating member in the form of a disk-shaped turntable, and a rotary encoder which generates pulse signals corresponding to the rotation direction and amount of the operating member, and the angle change detector 15 inputs thereto the pulse signals generated from the scratch disk 14 to detect the amount of change in the rotation angle (relative angular position) of the scratch disk 14 (relative position) on the basis of the input pulse signals. Alternatively, the scratch disk and angle change detector may comprise a wheel of the center-returning type such as a pitch bend wheel (type which automatically rotates back to the central position when released). Namely, the center-returning type wheel may function to output relative velocity data of positive or negative value depending on the direction and position of its rotation about the central position that corresponds to a reference value of zero, or may function to output acceleration data of positive or negative value depending on the direction and position of its rotation.

Furthermore, although the embodiment has been described in connection with such a case where the rate generator 13 provides the address counter 20 with rate data RD whose value ranges from "+16" to "−16" depending on the sum of the scratch data SCD and the rate offset envelope data ROE from the rate offset envelope generator 19, the product of the scratch data SCD and the rate offset envelope data ROE may be output as rate data RD for a predetermined range, or the rate data RD may be output depending on only one of the scratch data SCD and rate offset envelope data ROE.

With the above-mentioned arrangements, the present invention achieves the superior advantage that, by reversely or backwardly reading out waveform data stored in a predetermined sampling sequence, it is possible to impart a generated sound a special effect that is equivalent to the scratch effect normally obtained by forcing a record to rotate in the reverse direction.

What is claimed is:

1. An electronic sound signal generator comprising:

waveform storage means for storing sound waveform data in a predetermined order;

rate designation means for designating a readout rate to read out the waveform data from said waveform storage means in correspondence to a given pitch;

scratch control means for generating time-variable scratch control data to control readout rate and readout direction;

rate change means for changing the readout rate designated by said rate designation means in accordance with the scratch control data, the readout rate thus changed by said rate change means being of a positive or negative value; and readout control means for performing a control such that the waveform data are read out from said waveform storage means on the basis of the changed readout rate, a direction in which the waveform data are read out from said waveform storage means being controlled to be a forward or reverse direction depending on whether the changed readout rate is of a positive or negative value.

2. An electronic sound signal generator as defined in claim 1 wherein said scratch control means includes a manual operating member and generates said scratch control data corresponding to an operation amount of the operating member.

3. An electronic sound signal generator as defined in claim 1 wherein said scratch control means includes a reversible manual operating member and generates said scratch control data corresponding to operation amount and operation direction of the operating member.

4. An electronic sound signal generator as defined in claim 1 wherein said rate designation means includes pitch designation means for designating a desired pitch and rate data generation means for generating rate data corresponding to the pitch designated by said pitch designation means, and wherein the rate data is output as data designating said readout rate.

5. An electronic sound signal generator as defined in claim 1 which further comprises instruction means for instructing a sound generation, and wherein said scratch control means includes function waveform generation means for generating a function waveform in response to a sound generation instruction given by said instruction means, and said scratch control means generates the scratch control data on the basis of the function waveform.

6. An electronic sound signal generator as defined in claim 1 wherein said rate change means does not change the readout rate when the scratch control data is indicative of a predetermined value but changes the readout data when the scratch control data is indicative of an other value than the predetermined value.

7. An electronic sound signal generator as defined in claim 1 wherein when the changed readout rate is of a positive value, said readout control means reads out the waveform data from said waveform storage means in the forward direction at a rate according to the positive value, and when the changed readout rate is of a negative value, said readout control means reads out the waveform data from said waveform storage means in the reverse direction at a rate according to the negative value, and when the changed readout rate is zero, said readout control means stops reading out the waveform data.

8. An electronic sound signal generator comprising:

waveform storage means for storing sound waveform data;

rate designation means for designating a reference readout rate to read out the waveform data from said waveform storage means in correspondence to a given pitch;

scratch control means for generating scratch control data to control readout rate and readout direction, the scratch control data being indicative of a predetermined value when the readout rate and readout direction are not controlled; and readout control means for performing a control such that when the scratch control data is indicative of the predetermined value, the waveform data are read out from said waveform storage means in accordance with the reference readout rate, but when the scratch control data is indicative of an other value than the predetermined value, the waveform data are read out from said waveform storage means in a forward or reverse direction at a readout rate controlled in accordance with the other value.

9. An electronic sound signal generator as defined in claim 8 wherein said readout control means includes operation means for performing an operation to change rate data indicative of the reference readout rate in accordance with the scratch control data; wherein when the scratch control data is indicative of the predetermined value, the rate data is output from said operation means without being changed, and when the scratch control data is indicative of the other value than the predetermined value, an operation result obtained by changing the rate data is output from said operation means, said changed rate data being indicative of a positive or negative value; and wherein when the changed rate data is indicative of the positive value, the waveform data are read out from said waveform storage means in the forward direction, and when the changed rate data is indicative of the negative value, the waveform data are read out from said waveform storage means in the reverse direction, and when the changed rate data is indicative of zero, readout of the waveform data is stopped.

10. An electronic sound signal generator comprising:

waveform storage means for storing sound waveform data on plural cycles of a sound waveform;

rate designation means for designating a readout rate to read out the waveform data from said waveform storage means in correspondence to a given pitch;

scratch control means for, while the waveform sound data are read out, giving a reverse direction readout instruction; and readout control means for controlling readout from said waveform storage means of the sound waveform data in accordance with a combination of the readout rate designated by said rate designation means and the instruction given by said scratch control means, wherein said waveform storage means stores waveform data on attack and loop portions of the sound waveform, and reproduction of the sound waveform in a forward direction is performed by reading out the waveform data on the attack portion and then repetitively reading out the waveform data on the loop portion, and wherein when the reverse-direction readout instruction is given by said scratch control means while the waveform data on the loop portion are read out, said readout control means repetitively reads out only the waveform data on the loop portion in the reverse direction until the reverse-direction readout instruction is over.

11. An electronic sound signal generator as defined in claim 10 wherein when the reverse-direction readout instruction is given by said scratch control means while the waveform data on the attack portion are read out, said readout control means reads out the waveform data on the attack portion in the reverse direction only once until the reverse-direction readout instruction is over.

* * * * *